US005477710A

United States Patent [19]

Stefanutti

[11] Patent Number: 5,477,710

[45] Date of Patent: Dec. 26, 1995

[54] DEVICE FOR PROTECTING A PADLOCK

[76] Inventor: Riccardo M. Stefanutti, 15 Channel Road, Mount Evelyn, Victoria, 3796, Australia

[21] Appl. No.: 137,188

[22] PCT Filed: Apr. 24, 1992

[86] PCT No.: PCT/AU92/00188

§ 371 Date: Dec. 15, 1993

§ 102(e) Date: Dec. 15, 1993

[87] PCT Pub. No.: WO92/19833

PCT Pub. Date: Nov. 12, 1992

[30] Foreign Application Priority Data

Apr. 26, 1991 [AU] Australia ..... 76154/91

[51] Int. Cl.[6] ..... E05B 67/38

[52] U.S. Cl. ..... 70/56; 70/54; 70/417

[58] Field of Search ..... 70/54–56, 417, 70/DIG. 43, 2, DIG. 56; 292/281

[56] References Cited

U.S. PATENT DOCUMENTS

| | | | |
|---|---|---|---|
| 547,550 | 10/1895 | Hopkins | 70/56 |
| 899,268 | 9/1908 | Soley | 70/53 |
| 3,392,555 | 7/1968 | Beaver | 70/56 |
| 3,828,591 | 8/1974 | Beaver | 70/56 |
| 4,096,718 | 6/1978 | Michelman et al. | 70/54 X |
| 4,106,315 | 8/1978 | Dohanyos | 70/56 |
| 4,157,653 | 6/1979 | Dohanyos | 70/56 X |
| 4,819,465 | 4/1989 | Stanich | 70/56 |
| 4,843,845 | 7/1989 | Poe | 70/54 |
| 4,905,486 | 3/1990 | Appelbaum | 70/55 X |
| 5,219,384 | 6/1993 | Elsfelder et al. | 70/56 X |

FOREIGN PATENT DOCUMENTS

| | | | |
|---|---|---|---|
| 413366 | 4/1946 | Italy | 70/55 |
| 8264 | of 1901 | United Kingdom | 70/54 |
| 2185519 | 7/1987 | United Kingdom | 70/54 |

*Primary Examiner*—Lloyd A. Gall
*Attorney, Agent, or Firm*—Nixon & Vanderhye

[57] ABSTRACT

A device (2) for protecting a padlock (22) and a lock (40,44,48) to which the padlock is connected, the device includes a shield portion (4) which is in the form of a generally C-shaped body having a mounting plate (6) extending across the body, the mounting plate (6) includes openings (6 and 18) through which the padlock shackle (26) passes, the device being held captive relative to the lock and substantially surrounding the padlock shackle and parts of the lock in order to minimise tampering of the padlock and the lock.

16 Claims, 6 Drawing Sheets

DEVICE FOR PROTECTING A PADLOCK

FIELD OF THE INVENTION

This invention relates to a device for protecting a padlock.

BACKGROUND AND SUMMARY OF PRIOR ART

Padlocks are frequently used to prevent opening of various types of locks such as bolt locks, hasp locks and double angle locks. Generally speaking, the padlock is easily accessible to tampering. The padlock may be broken by using bolt cutters he shackle away from the body of the padlock. Various arrangements have been proposed to protect padlocks from this form of tampering. See for instance U.S. Pat. Nos. 4,033,156; 4,238,941; 3,828,591; 4,879,889; and 3,718,014; U.K. patent specification Nos. 2,206,376A and 2,185,519A; and Australian patent specification Nos. 26903/88; 23818/88; 60776/86; 57622/80; 66735/90 and 38235/89. Another weakness with locks which are secured by padlocks is the problem of sawing through the shackle, loop or hole through which the padlock shackle passes so as to open the lock. This problem is addressed by some of the known arrangements but they tend to be cumbersome or involve providing a substantially closed housing for the padlock. U.K. specification No. 2,185,519A discloses a comparatively simple device but it would have the practical disadvantage that the lock to which it is coupled would not be satisfactorily protected. Also it appears to be restricted to use with only hasp and staple types of locks.

SUMMARY OF THE INVENTION

The object of the invention is to provide a comparatively simple, robust and effective device which protects both the padlock and pans of the lock to which the padlock is coupled and which can be used with a number of different locks.

According to the present invention there is provided a device for protecting a padlock and lock, the padlock including a body and shackle, the lock including a first portion mounted on a surface, the first portion having a shackle, loop or hole which, in use, is coupled to the shackle of the padlock; said device including a shield portion having first, second and third legs disposed to form a generally C-shaped body, a mounting member mounted within said C-shaped body, said member including an opening or openings through which, in use, the padlock shackle passes to hold the device captive relative lock with the padlock and the shackle, loop or hole of the first portion of the lock being substantially covered by said C-shaped body characterised in that the first a,and third legs of said body extend, in use, towards said surface and include projections which, in use, lie adjacent to said surface.

When the device of the invention is used to protect a padlock on a bolt type, hasp type or double angle type of lock, the lock itself is frequently mounted on a solid surface such as a wall or door jamb or the like. The device of the invention together with the surface upon which the lock is mounted at least partially surrounds the padlock so as to make it very difficult to tamper with the hook of the padlock. In addition, the device also serves to protect the hole or loop of the lock upon which the padlock is mounted.

BRIEF DESCRIPTION OF THE DRAWING FIGURES

The invention will now be further described with reference to the accompanying drawings, in which.

DESCRIPTION OF A PREFERRED EMBODIMENT

Figure 1:
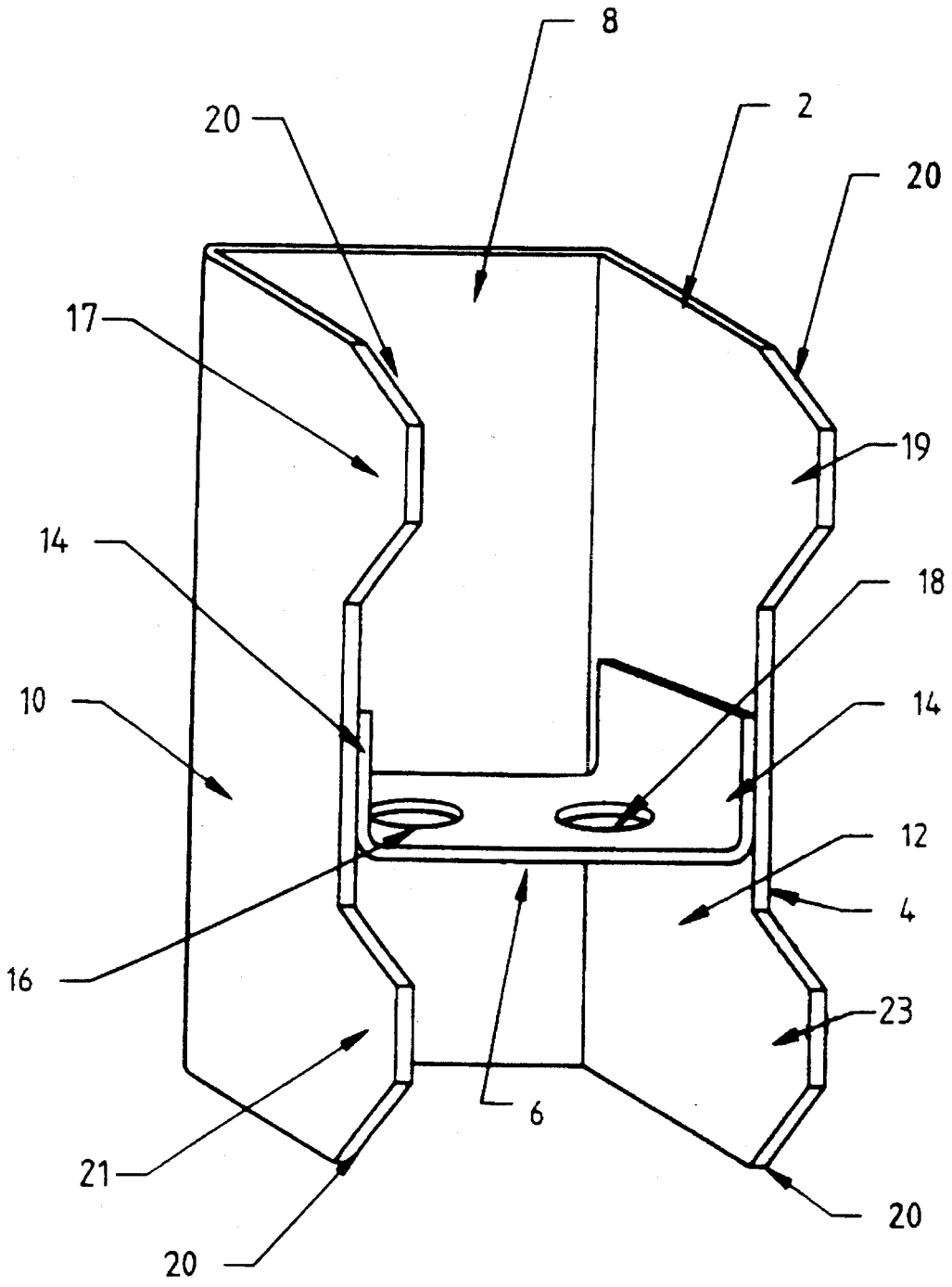
FIG. 1 is a perspective view of the device of the invention.
Figure 4:
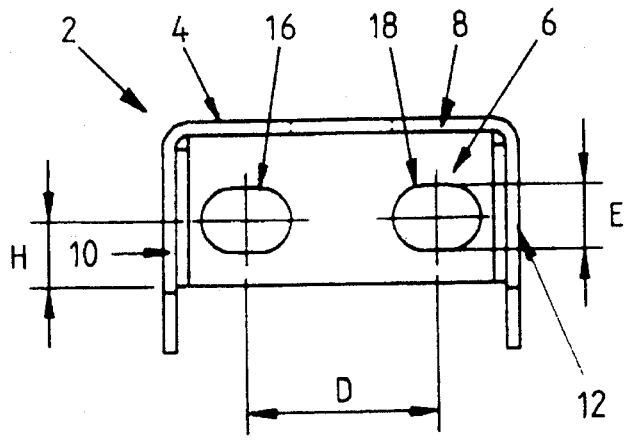
FIG. 4 is a plan view of the device.
Figure 3:
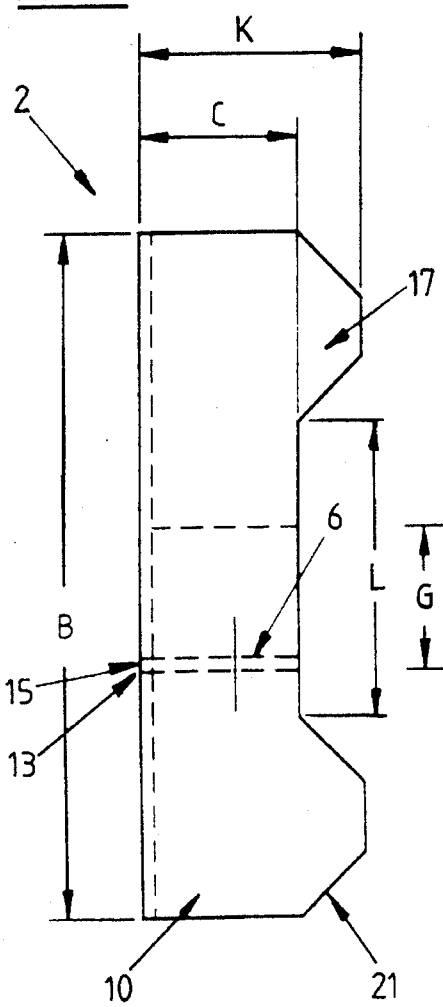
FIG. 3 is a side view of the device.
Figure 2:
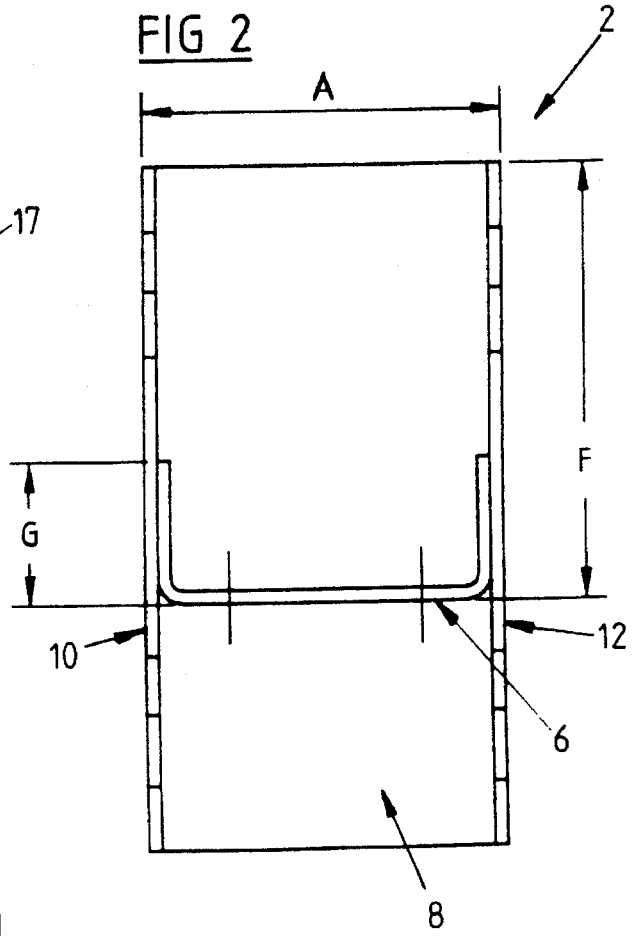
FIG. 2 is a rear view of the device.

The device 2 of the invention is shown in FIGS. 1 to 4. It comprises a channel portion 4 and cross plate 6. The channel portion 4 is formed from sheet metal so as to have a front leg 8 and two side legs 10 and 12. The channel portion 4 is preferably formed from steel plate 1.5 to 5 mm thick and preferably 2 mm thick. The material may be galvanised plated or plastic coated so as to protect its surface. The cross plate 6 is formed with a pair of mounting flanges 14 which lie inwardly adjacent to the side legs 10 and 12 of the channel member. The flanges 14 are preferably spot welded to the respective side legs 10 and 12. The inner edge of the plate 6 includes a lug 13 which is received in slot 15 formed in the front leg 8. The lug 13 interlocks with the slot 15 and strengthens the connection of the plate 6 to the channel portion 4. The cross plate 6 includes two opening 16 and 18 which are preferably somewhat elongate or oval as shown in FIGS. 1 and 4. The upper and lower edges of the side walls 10 and 12 may include chamfers 20 which reduce the leverage area where a pinch bar or lever could be applied to the device in order to lever it off. The chamfers 20 also avoid sharp edges and facilitate manipulation of the device in proximity to locks.

The inner edges of the side legs 10 and 12 include upper projections 17 and 19 and lower projections 21 and 23. The principal function of the projections is to assist in protecting the lock to which the padlock is coupled, as will be described below.

Figure 5:
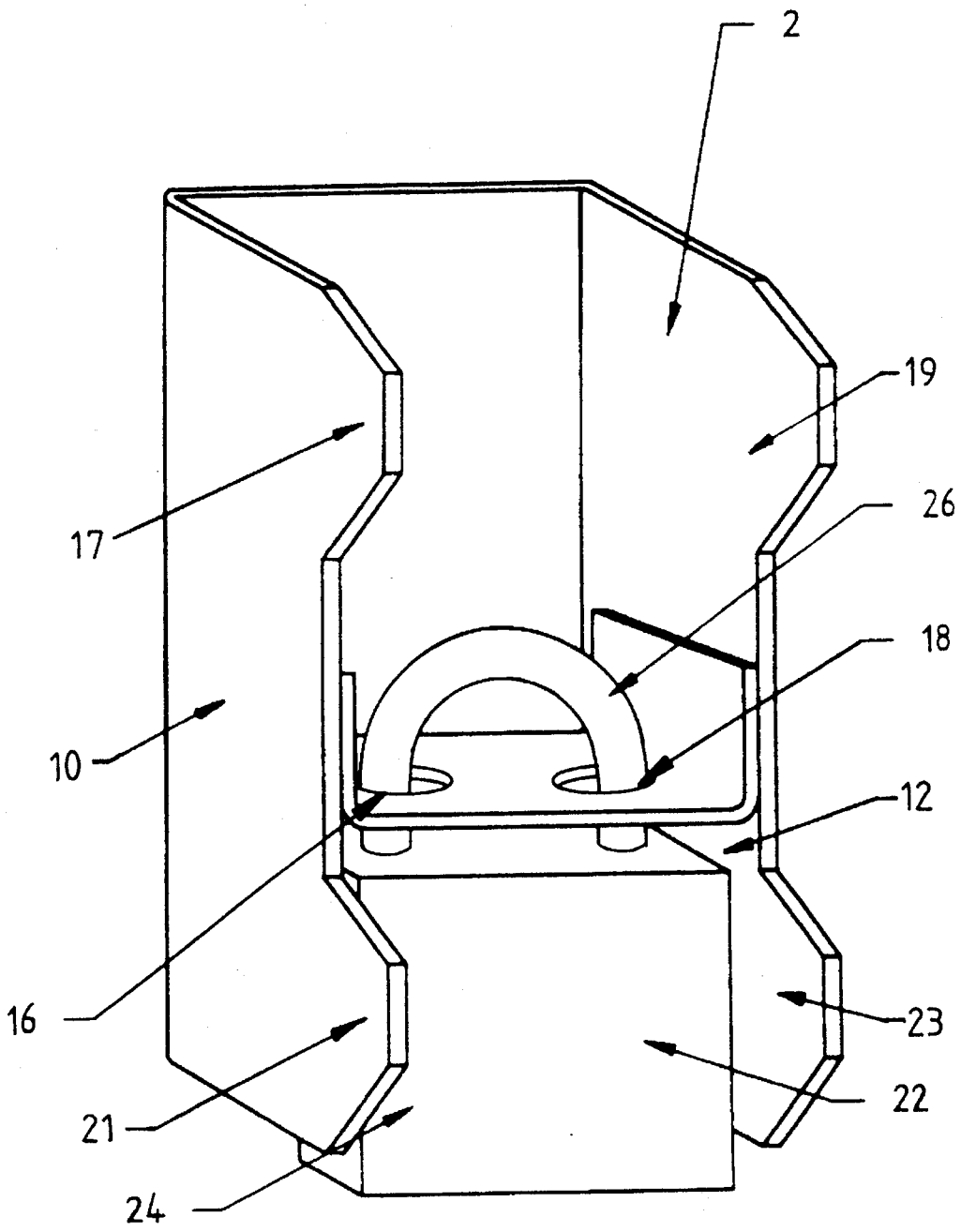
FIG. 5 is a perspective view showing the device mounted on a padlock.

FIG. 5 illustrates the use of the device 2 with a padlock 22. The padlock has a body 24 and shackle 26 and it will be seen that the shackle of the padlock can be positioned so that it passe through both of the openings 16 and 18. In this position, the shackle 26 lies generally within the channel portion 4 of the device.

Figure 6:
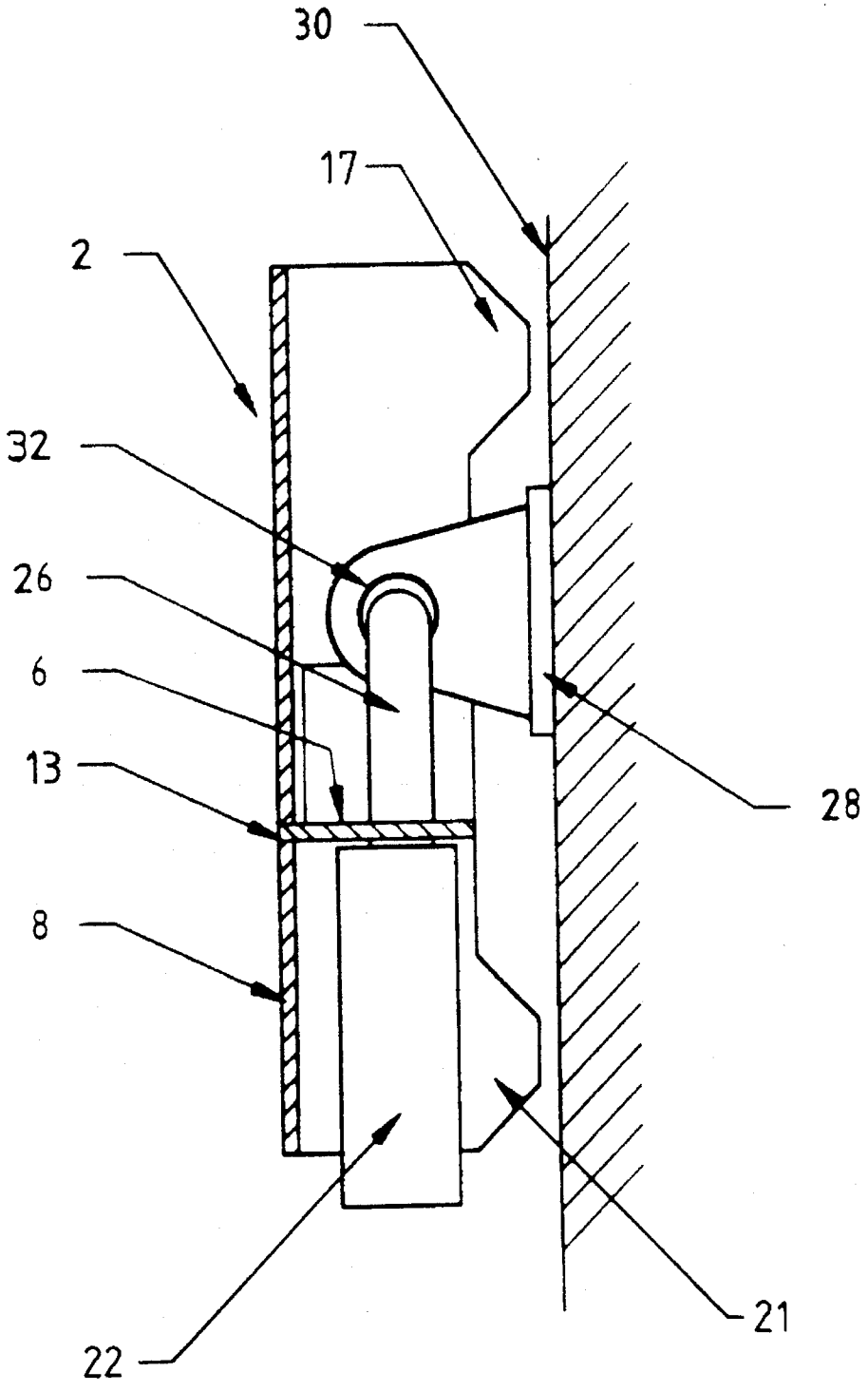
FIG. 6 is a schematic view partly in section showing the device in situ.

FIG. 6 shows the device 2 of the invention when used in conjunction with a lock 28 mounted on a surface 30. The lock 28 includes an eyelet 32 through which the shackle 26 of the padlock passes. The shackle 26 also passes through the plate 6 of the device in the same manner as illustrated in FIG. 5. When the padlock is locked, the shackle of the padlock supports the device 2 such that generally speaking the shackle 26 is surrounded by the channel member 4 and the surface 30. This makes tampering with the shackle of the padlock very difficult. The eyelet 32 of the lock is also substantially surrounded which would make it difficult to break the lock by sawing through the eyelet. It will be noted that projections 17, 19, 21 and 23 are located closely adjacent to the surface 30. This would make it very difficult to get access to the lock 28 by a saw blade or the like. The recesses defined between the projections 17 and 21, and 19 and 23 can accommodate parts of the lock 28.

Figure 7:
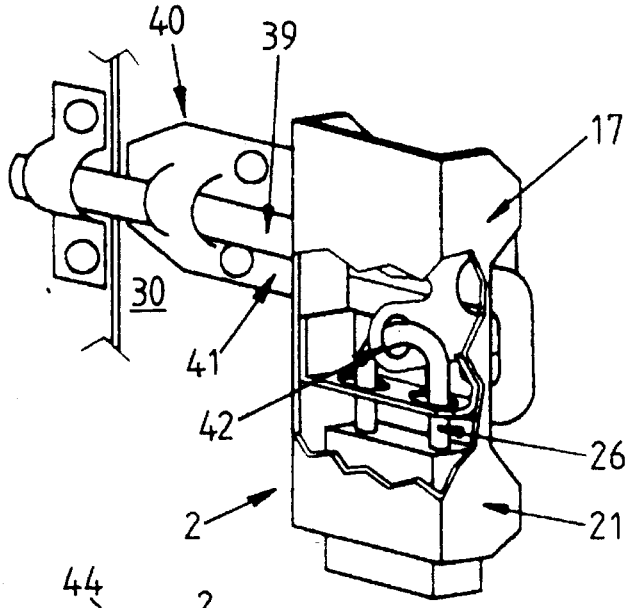
FIG. 7 illustrates the use of the device on a bolt type lock.

FIG. 7 illustrates the use of the device 2 in conjunction with a bolt type lock 40 having a sliding bolt 39, mounting plate 41 and a pair of eyelets 42, only one of which is illustrated. FIG. 7 shows the lock with the bolt 39 closed with the device 2 of the invention coupled to the lock. It will be seen that the shackle 26 of the padlock passes through the openings 16 and 18 of the device 2 as well as one of the eyelets 42. The device 2 substantially surrounds the padlock and therefore tends to minimise the possibility of tampering with the shackle 26 of the padlock. The projections 17, 19, 21 and 23 are located close to the surface 30 upon which the lock 40 is mounted. The recesses between the projections 17 and 21, and 19 and 23 provide clearance for the bolt 39 and mounting plate 41.

Figure 8:
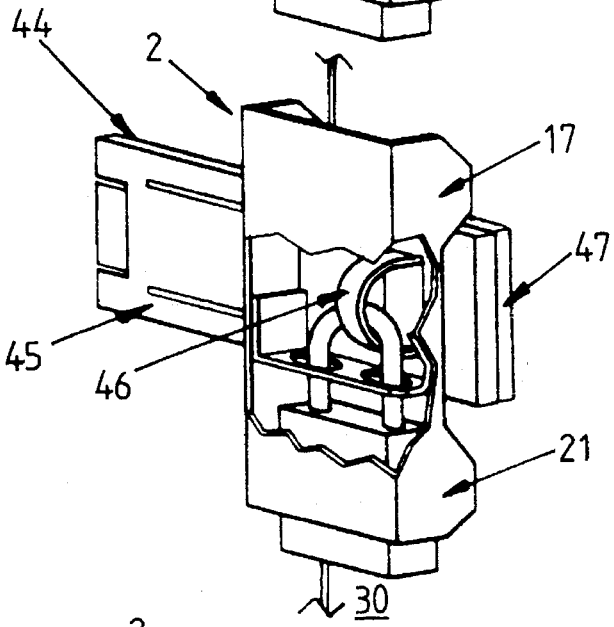
FIG. 8 illustrates the use of the device with a hasp type lock.

FIG. 8 illustrates the use of the device 2 in conjunction with a hasp type lock 44 having a hasp 45 and loop 46 projecting from a mounting plate 47. FIG. 8 shows the hasp lock closed with the padlock 22 and device 2 of the invention coupled thereto. It will be seen that the device 2 again protects the shackle of the padlock and also the loop 46 of the lock. The recesses between the projections accommodate the hasp 45 and mounting plate 47 so that the inner extremities lie closely adjacent to the surface 30 upon which the mounting plate 47 is mounted. Again this substantially prevents a saw blade being used to cut the loop 46.

Figure 9:
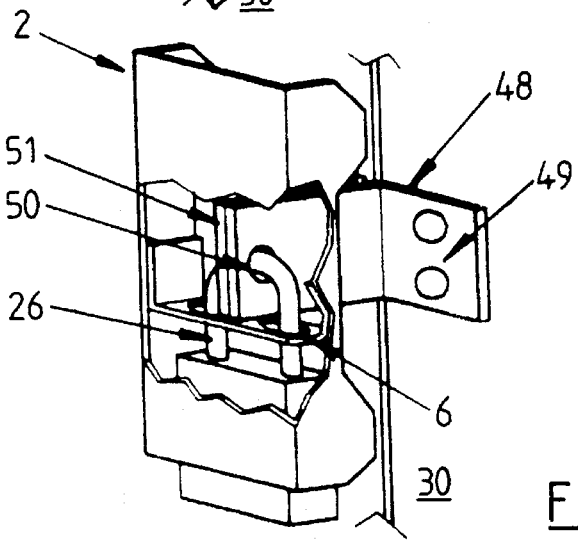
FIG. 9 illustrates the use of the device with a double angle type lock.

FIG. 9 illustrates the use of the device 2 in connection with a double angle type lock 48 having a pair of angle brackets 49, 51 each with an eyelet 50. FIG. 9 shows the shackle of the padlock passing through the aligned cyclers 50 as well as through the cross plate 6 of the device 2. Again, the device 2 protects the hook of the padlock as well as the eyelets. Again the spaces between the projections 17 and 21, and 19 and 23 accommodate parts of the brackets 49 and 51.

Figure 11:
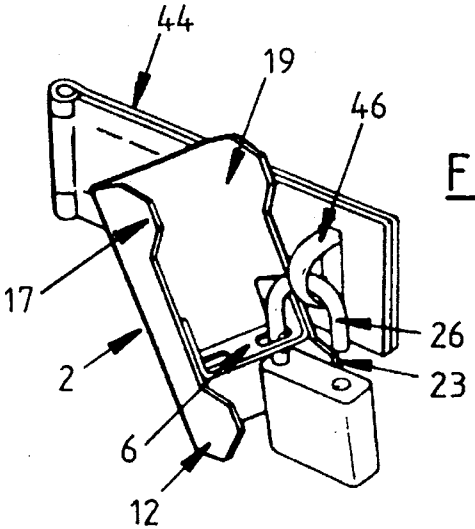
FIGS. 10 to 13 illustrate one technique for mounting the device on a hasp type lock.
Figure 13:
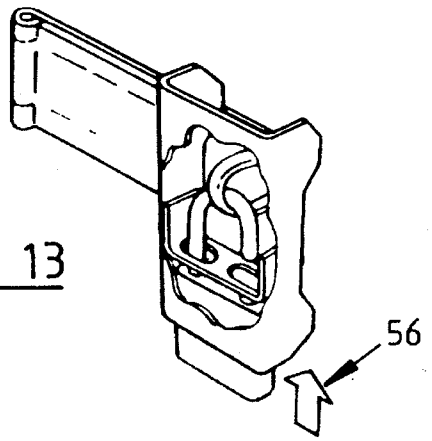
Figure 10:
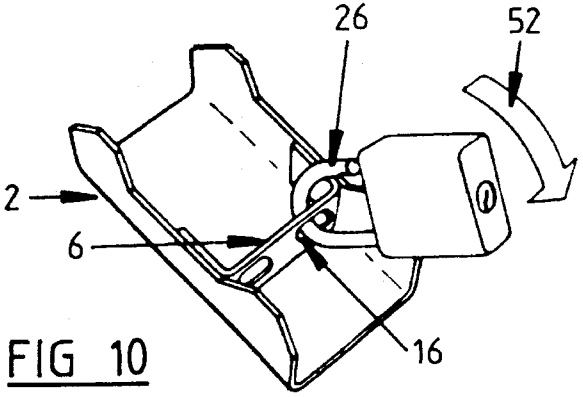
Figure 12:
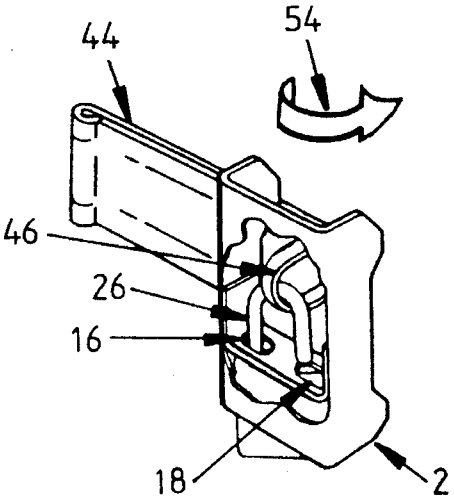

FIGS. 10 to 13 diagrammatically illustrate one technique for mounting the padlock on the device 2 and a hasp lock 44. FIG. 10 shows the padlock 22 having its shackle 26 open so that the free end of the hook can pass through the opening 16 of the device. The padlock is then rotated in the direction of arrow 52 so that the free end of the shackle extends away from the plate 6, as seen in FIG. 11. The shackle 26 is then passed through the loop 46 of the hasp lock 44. The recess between the projections 19 and 23 allow the free end of the shackle 26 to reach and pass through the loop 46 of the lock. The padlock body and device 2 are then rotated about a generally vertical axis, as indicated by arrow 54, until the free end of the shackle 26 is aligned with the hole 18 through the plate 6, as shown in FIG. 12. The padlock is then lowered so that the free end of the hook passes through the opening 18. The padlock is then locked by moving the padlock body 24 upwardly relative to the shackle 26 as indicated by arrow 56 in FIG. 13 until the free end of the shackle is locked within the padlock body in the usual way.

Similar techniques can be used for mounting the device 2 on other forms of locks.

The dimensions of the device 2 can be varied in accordance with the sizes of the padlocks to be protected. Table 1 below sets out some examples of devices of the invention and the various dimensions A,B,C,D,E,F,G,H,K and L which arc marked in FIGS. 2, 3 and 4. The dimensions in Table 1 are shown in millimeters.

| MODEL | A | B | C | D | E | F | G | H | K | L |
|---|---|---|---|---|---|---|---|---|---|---|
| Example 1 | 80 | 120 | 30 | 40 | 12 | 75 | 20 | 10 | 40 | 65 |
| Example 2 | 56 | 110 | 25 | 30 | 10 | 70 | 20 | 10 | 35 | 52 |
| Example 3 | 36 | 60 | 20 | 15 | 6 | 40 | 10 | 8 | 30 | 35 |

It will be appreciated from the above that the projections 17, 19, 21 and 23 extend about 10 mm beyond the free edges of the side plates 10 and 12 regardless of the size of the device. This is significant because the general scale of the device 2 is related to the size of the padlock to be used but the clearance provided by the projections 17, 19, 21 and 23 tends to be related to the size: of the lock with which the device 2 is to be used.

It will be further appreciated by those skilled in the art that the shape of the projections 17, 19, 21 and 23 can be varied. For instance, they may comprise semi-circular projections or rectangular projections or any combination. From a functional point of view, their inner ends should lie as close as possible to the surface 30 upon which the lock is mounted so as to provide maximum protection for the lock. As mentioned above, the space between the projections which defines recesses should be reasonably generous so as to accommodate locks of different sizes.

In use it is preferred that the inner ends of the projections 17, 19, 21 and 23 are spaced from the surface 30 by a distance in the range from 1 to 5 mm and preferably about 2 mm but this will of course depend on the size and geometry of the lock.

Of course other sizes could be made to meet particular requirements.

Many modifications will be apparent to those skilled in the an without departing from the spirit and scope of the invention. For instance, the legs 8, 10 and 12 need not be planar. The leg 8 does not need to be truly perpendicular to the legs 10 and 12. The holes 16 and 18 could be joined to form a slot.

I claim:

1. A device for protecting a padlock and lock, the padlock including a body and shackle, the lock including a first portion mounted on a surface, the first portion having a shackle, loop or hole which, in use, is coupled to the shackle of the padlock; said device including a shield portion having first, second and third legs disposed to form a generally C-shaped body, a mounting member mounted within said C-shaped body and being connected to said first and third legs, said member including an opening or openings through which, in use, the padlock shackle passes to hold the device captive relative to the lock with the padlock and the shackle, loop or hole of the first portion of the lock being substantially covered by said C-shaped body, said first and third legs having inner edges each having a recess therein spaced from opposite ends of the legs, said inner edges, in using said device, lying closely adjacent to said surface with parts of the lock accommodated in at least one of said recesses.

2. A device as claimed in claim 1 including two projections on each of said inner edges of said first and third legs, the recesses being defined therebetween.

3. A device as claimed in claim 2 wherein said projections are located near upper and lower ends of the first and third legs.

4. A device as claimed in claim 1 wherein the mounting member includes a plate which lies in a plane transverse to the planes of the first, second and third legs.

5. A device as claimed in claim 4 wherein said plate includes two of said openings.

6. A device as claimed in claim 5 wherein said openings are oval shaped.

7. A device as claimed in claim 4 wherein said plate is integrally formed with end flanges which are welded to opposed faces of the first and third legs.

8. A device as claimed in claim 7 wherein said plate includes a projecting lug which is snugly received in a slot formed in the second leg.

9. A device as claimed in claim 1 wherein the width of the second leg is in the range of about 36 to 80 mm.

10. A device as claimed in claim 9 wherein the length of the second leg is in the range of about 60 to 120 mm.

11. A device as claimed in claim 10 wherein the first and third legs have widths in the range of 20 to 30 mm.

12. A device as claimed in claim 11 wherein projections project from the first and third legs by a distance of about 10 mm.

13. A device as claimed in claim 12 wherein the spacing between pairs of projections is in the range of about 35 to 65 mm.

14. A device as claimed in claim 1 wherein the shield portion is integrally formed from steel plate about 2 mm in thickness.

15. A device as claimed in claim 1 wherein ends of said inner edges are chamfered.

16. A device as claimed in claim 1 including two projections on each of said inner edges of said first and third legs, said mounting member including a plate lying in a plane transverse to the planes of the first, second and third legs and between said projections.

* * * * *